US005105950A

United States Patent [19]

Gottfreid et al.

[11] Patent Number: 5,105,950

[45] Date of Patent: Apr. 21, 1992

[54] ZIP OFF LID FOR TWO PIECE CRUSHABLE CARTON

[75] Inventors: Thomas M. Gottfreid, Mundelein, Ill.; Walter J. Rosenbaum, Indianapolis, Ind.

[73] Assignee: Moore Business Forms, Inc., Grand Island, N.Y.

[21] Appl. No.: 583,371

[22] Filed: Sep. 17, 1990

[51] Int. Cl.[5] ..... B65D 5/54

[52] U.S. Cl. ..... 229/210; 229/125.19; 229/125.33

[58] Field of Search ..... 206/611, 628, 606, 625; 229/125.33, 125.19

[56] References Cited

U.S. PATENT DOCUMENTS

| | | | |
|---|---|---|---|
| 1,143,250 | 6/1915 | Butler | 229/45 R |
| 2,354,543 | 7/1944 | Ratcliff | 206/611 |
| 2,358,790 | 9/1944 | Carruth | 229/43 |
| 2,791,367 | 5/1957 | Mefford | 229/41 |
| 2,880,866 | 4/1959 | Van Dyck | 229/125.19 |
| 2,885,137 | 5/1959 | Guyer | 229/125.19 |
| 2,936,941 | 5/1960 | Lewis | 206/606 |
| 3,131,851 | 5/1964 | Pace | 206/628 |
| 3,306,437 | 2/1967 | Nelson | 206/628 |
| 3,313,467 | 4/1967 | Anderskow et al. | 229/37 |
| 3,355,089 | 11/1967 | Champlin | 206/614 |
| 3,458,109 | 7/1969 | Compton et al. | 206/628 |
| 3,495,760 | 2/1970 | Poth | 229/52 |
| 3,583,597 | 6/1968 | Buttery | 206/611 |
| 3,743,167 | 7/1973 | Russell | 229/125.19 |
| 3,896,607 | 7/1975 | Royal | 229/125.19 |
| 3,910,483 | 10/1975 | Ritter | 229/125.33 |
| 4,160,519 | 7/1979 | Gorham | 229/37 |
| 4,328,924 | 5/1982 | Neff et al. | 206/606 |
| 4,362,265 | 12/1982 | Williams | 229/125.19 |
| 4,742,917 | 5/1988 | Bornwasser et al. | 229/125.19 |
| 4,757,902 | 7/1988 | Hutchinson et al. | 206/611 |
| 4,848,651 | 7/1989 | Hartness | 229/125.33 |

*Primary Examiner*—Stephen Marcus
*Assistant Examiner*—Christopher McDonald
*Attorney, Agent, or Firm*—Nixon & Vanderhye

[57] ABSTRACT

A cardboard carton lid is constructed so that the carton may be securely packed and shipped without the necessity for plastic strapping, and using lower strength paperboard than is conventionally provided, yet allow the carton lid to be reused. The lid has elongated side panels with first and second parallel lines of weakness (e.g. perforations) formed in them. The bottom, fastening portion of the side panels is secured—as by adhesive—to the carton body side walls. A blank, and enlarged grasping portion in the carton lid side panels at the lines of weakness allow a user to grasp the strip between the lines of weakness and detach the lid from the securing portions of the side panels. The lid can be reused after detachment. The carton is packed with nondeformable material such as business forms which extend above the top edge of the carton. After the lid is compressed, to reduce voids in the material, the components are maintained in the compressed condition, and the side panels are glued to the carton body side walls, without interfering with the ability of the lid to flex at the lines of weakness. The lid will flex at the lines of weakness during use.

21 Claims, 3 Drawing Sheets

ZIP OFF LID FOR TWO PIECE CRUSHABLE CARTON

BACKGROUND AND SUMMARY OF THE INVENTION

Business forms, paper, and many other products are conventionally shipped and stored in two piece cartons having a carton body and a top, both of cardboard. Since it is highly desirable for the carton lids to be reused in such cartons, the carton lid is typically secured to the carton body by plastic straps. This is an expensive procedure, however, since there is a substantial investment in automatic strapping equipment, since the plastic straps are relatively expensive, and since there are significant maintenance costs associated with the automatic strappers. Therefore, it is highly desirable to provide a carton with a reusable lid that may be shipped without plastic strapping, while still securely maintaining the carton contents.

Further, in conventional corrugated cartons, during shipping and handling varying amounts of weight and momentum are applied to the carton. This has led many users of cartons to build higher cost and higher strength corrugated paperboard cartons in order to maintain a rigid box of unchanging depth. However, if the box is able to flex to accommodate varying amounts of weight and momentum that are applied during shipping and handling, lower cost paperboard may be utilized, yet the carton will retain its integrity and uniformity throughout its useful life. This is especially desirable in the area of packing paper products, such as business forms, which tend to expand and contract over time and to settle after initial packing since voids are common in the depth dimension.

According to the present invention, both of the above mentioned problems are solved in a simple and effective manner. According to the present invention the expensive strapping equipment necessary for most commercial carton packaging systems is eliminated, the cost of materials for packaging are greatly reduced, and since the equipment utilized to effect packaging according to the invention is much less expensive with a much simpler construction, equipment maintenance costs are substantially reduced. For example, according to the present invention the apparatus for effecting packaging can be about one-fifth the cost of conventional strapping equipment, while the operating cost per thousand cartons is less than one-tenth, and almost no maintenance is required. Also, according to the present invention 125 pound, 150 pound or 175 pound test corrugated paperboard may be utilized instead of 200 or 275 pound test corrugated paperboard typically used, and without the need for corrugated or Styrofoam ® filler pads that are typically utilized in conventional cartons.

According to the most basic aspect of the present invention, the above highly desirable results are achieved by constructing a cardboard carton lid in such a way that it has elongated side sections or panels, with a bottom portion thereof attached by adhesive—or other fastening means—to the side walls of the carton body. First and second parallel lines of weakness are provided between the top and bottom edges of the carton side panels, the carton flexing along those lines of weakness during handling, the flexing action allowing lower weight paperboard materials to be utilized. The carton may be easily opened by removing the strip between the lines of weakness, after the strip removal the carton lid being essentially the same as a conventional carton lid, and readily reusable. During packing of the carton, the carton will be filled above the top of the carton body (e.g. by business forms stacked an inch above the carton top edge), and a compressive force will be applied to the carton to reduce void volume prior to adhesion of the side sections to the carton side walls. This, combined with the flexing action about the lines of weakness, allows the carton to retain its integrity and uniformity throughout customer use, and improves protection for the product packaged and the customer perception of product quality.

According to one aspect of the present invention, a cardboard carton lid is provided which comprises a top panel; first and second end panels each having a top edge and bottom edge, and extending generally perpendicular to the top panel and connected thereto at the top end of each, the bottom edge of each spaced a first distance from the top panel; at least one side panel having a top edge and bottom edge, and extending generally perpendicular to the top panel and connected to the top panel at the top edge thereof, the bottom edge spaced a second distance from the top panel; a first line of weakness formed in the side panel parallel to the top edge and between the top and bottom edges thereof, and a second line of weakness formed in the side panel parallel to the first line, and between the bottom edge and the first line; and the spacing between the second line of weakness and the bottom edge of the side panel being sufficient to define a bottom, fastening section of sufficient dimension to be securely attachable to a carton body. The lines of weakness preferably comprise perforations, and a removable strip is provided between the lines of weakness. Means are also provided for facilitating grasping of the removable strip to allow tearing of the side panel at the perforations so that the bottom, fastening section of the side panel is detached from the rest of the lid. Such means preferably comprise a die cut blank formed in the strip, and die cut lines adjacent the blank and forming a part of the lines of weakness, the die cut lines extending at a slight angle with respect to the perforation so as to provide an enlarged grasping portion of the strip therebetween. The carton lid may be formed of 175 pound test, or less, corrugated paperboard, as opposed to conventional 200 pound test corrugated paperboard.

A cardboard carton is provided according to the invention which has a body with opposite side and end walls, a closed bottom, and an open top defined by a top edge. A lid—as described above—is fastened to the carton body, by fastening means (e.g. glue or other adhesive) fastening the bottom fastening sections of the lid to the carton body side wall. The carton is typically filled with material to be packaged—e.g. sheets of paper (for example, business forms) extending from the carton bottom in a stack up past the top edge of the carton body.

According to another aspect of the present invention, a method of packing a cardboard carton is provided which comprises the following steps: (a) Filling the carton with substantially non-deformable material to be packaged so that the material contacts the carton body bottom and extends upwardly past the top edge of the carton body, (b) Placing the lid on the carton body so that the top panel thereof engages the material extending above the carton body top edge and so that the lid side and end panels overlap the carton side and end walls, respectively, (c) Applying a compressive force to the carton lid sufficient to reduce void spaces in the material to be packaged so that the lid top panel is moved closer to the carton body top edge. And, (d) while the components are in the compressed position of step (c), affixing the relatively long lid side panels to carton body side walls without interfering with the ability of the lid to flex at the lines of weakness, so that once step (d) is completed, the carton will flex at the lines of weakness. The method preferably consists essentially of only steps (a-(d), so that no strapping is necessary to maintain carton integrity. Typically, the carton is overfilled with paper, or business forms, e.g. to a height one inch above the carton body top edge.

The method according to the invention also has as an aspect thereof not only the method of packing the cardboard carton, but reusing the carton. The carton is packed as described above, and then the lid is detached from the body by removing a strip between the lines of weakness. The lid can be removed and replaced as desired—i.e. is completely reusable—and in fact even can be used for subsequent shipping by taping the lid to the side and/or end walls of the carton body.

It is the primary object of the present invention to provide a method of packaging utilizing a cardboard carton that is as effective or more effective than conventional packaging procedures, yet significantly less expensive and/or simpler; and an improved cardboard carton and lid. This and other objects of the invention will become clear from an inspection of the description of the invention and from the appended claims.

DETAILED DESCRIPTION OF THE DRAWINGS

Figure 1:
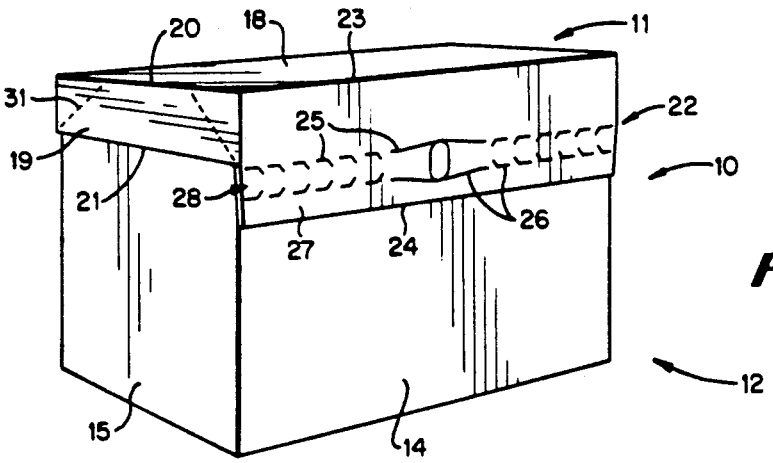
FIG. 1 is a side perspective view of an exemplary cardboard carton according to the present invention.

An exemplary cardboard carton according to the present invention is shown generally by reference numeral 10 in FIG. 1. While the term "cardboard" will be used throughout the specification and claims, it is to be understood that such term is used only generically, and includes corrugated and non-corrugated cardboard and/or paperboard, and all like materials typically used in cartons.

The main components of the cardboard carton 10 comprise a lid 11 and a body 12. The body 12 has a bottom 13 (see FIG. 3), a pair of end walls 15, and a pair of side walls 14. It also has an open top defined by a top edge 16 (see FIG. 3). Except for, the weight of the cardboard utilized, the bottom 13 is a conventional carton bottom of the type commonly used for packaging paper products, such as business forms, and the like.

The lid 11 according to the present invention is significantly different than conventional cardboard carton lids. The lid 11 includes a top 18 and a pair of end sections or panels 19, the end panels 19 have a top edge 20 connected to the top panel 18 and a bottom edge 21, the edges 20 and 21 spaced a first spacing, typically about three inches. The end sections 19 are substantially perpendicular to the top panel 18.

The lid 11 also comprises at least one—and preferably two—side panels 22, each having a top edge 23 thereof and a bottom edge 24, the spacing between the top edge 23 and the bottom edge 24 being a second spacing which is significantly greater than the first spacing. The panel 22 is also connected to the top panel 18 at the top edge 23 thereof, and is generally perpendicular to both the top panel 18 and the side panels 19.

Figure 5:
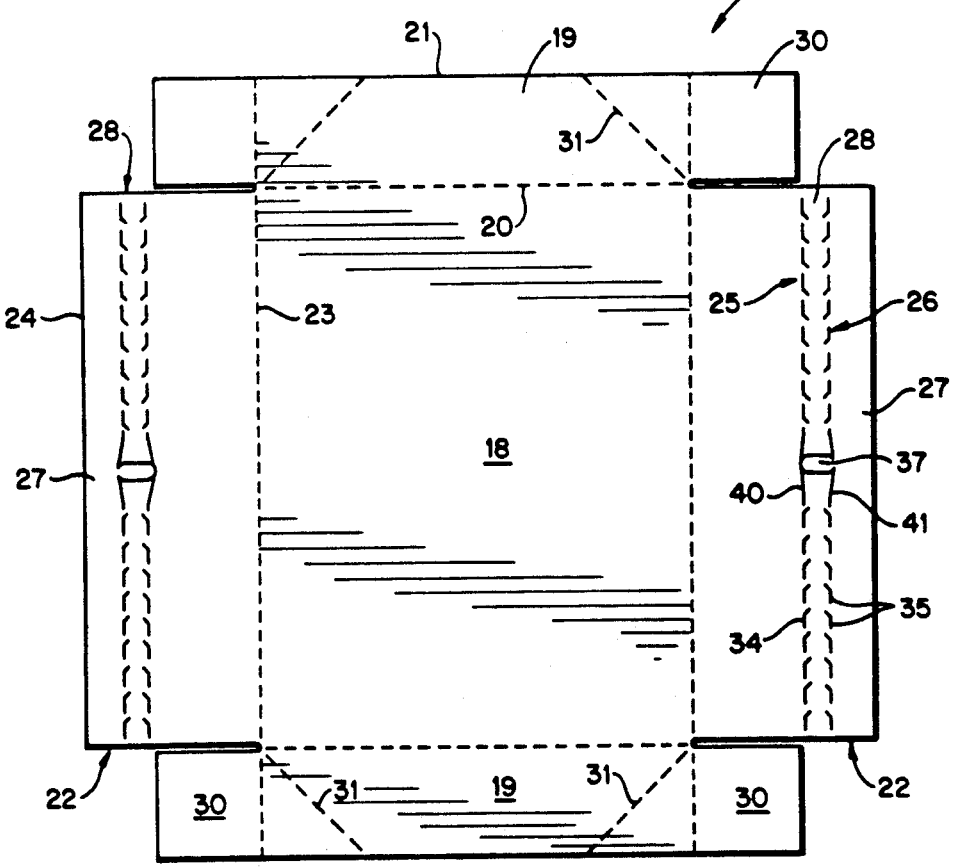
FIG. 5 is a top plan view of a blank for making the lid according to the invention.

Although not apparent in the other figures, as can be seen in FIG. 5, the end panels 19 preferably have a pair of ears 30 extending from each, and pre-fold score lines 31 therein, both of which are conventional. As is conventional, the ears 31 are tucked inside the side panels 22 and affixed to the side panels 22 with adhesive or other fasteners (e.g. staples).

Disposed in the side panels 22 are first and second lines of weakness 25, 26, preferably formed by perforations (34, 35) that are substantially parallel to each other and to top edge 23 and bottom edge 24. Between the bottom, second, line of weakness 26 and the bottom edge 24 is a section 27 of the side panel 22 which has a sufficient dimension to be securely attached to the side wall 14 of the carton body 12. Most desirably, the first, top, line of weakness 25 is disposed in alignment with the bottom 21 of the end panels 19 (e.g. about three inches from the top edge 23), and the spacing between the lines of weakness 25, 26 is about ½ to 1 inch, and the width of the bottom section 27 (the spacing between second line of weakness 26 and bottom edge 24) is about ¾-1½ inches. A removable strip 28 is provided between the lines of weakness 25, 26.

Figure 2:
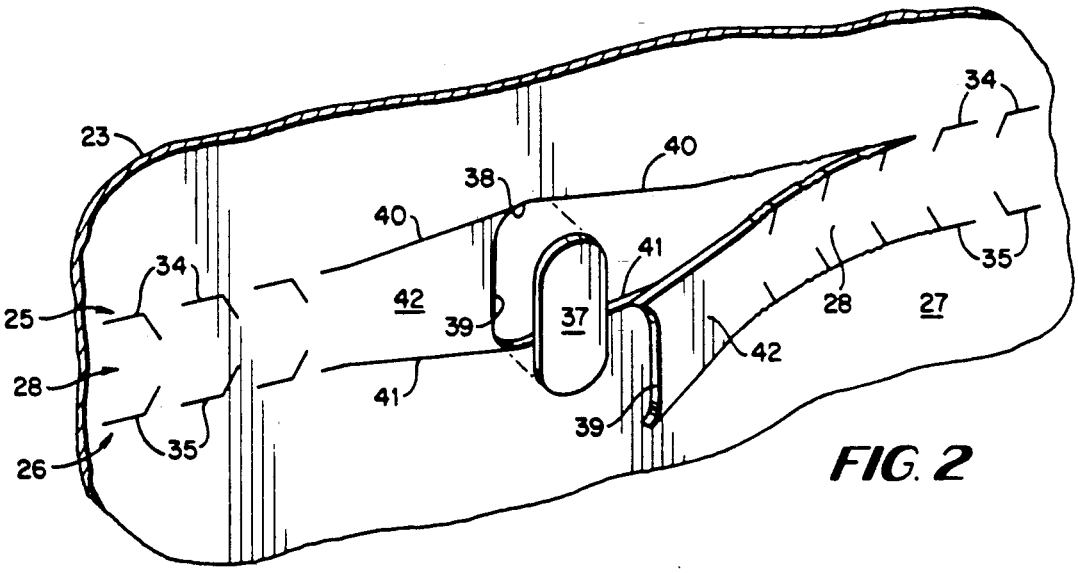
FIG. 2 is a detailed view of one of the side sections of the lid of the carton of FIG. 1 showing the manner of detachment thereof.

The carton lid 11 is also constructed so as to further provide means for facilitating grasping of the removable strip 28 to allow tearing of the side section at the perforations defining the lines of weakness 25, 26 so that the section 27 is detached from the rest of the lid 11. This is preferably accomplished—with particular reference to FIGURES 2 and 5—by providing a die cut blank 37, having a die cut 38 at the top and bottoms thereof, and side die cuts 39 with the removable strip 28, the blank 37 being provided in substantially the center of the side panel 22. The means for facilitating grasping further preferably comprise die cut lines 40, 41 extending from both sides of the blank 37 and formed at a slight angle with respect to the rest of the lines of weakness 25, 26 so as to provide enlarged grasping portions 42 in the strip 28. The perforations 34, 35 are parallel to each other, and generally in line with the die cut lines 40, 41, and may have the configuration illustrated in FIGS. 2 and 5, although other configurations are also possible, as long as they allow relatively ready detachment of the strip 28.

Figure 3:
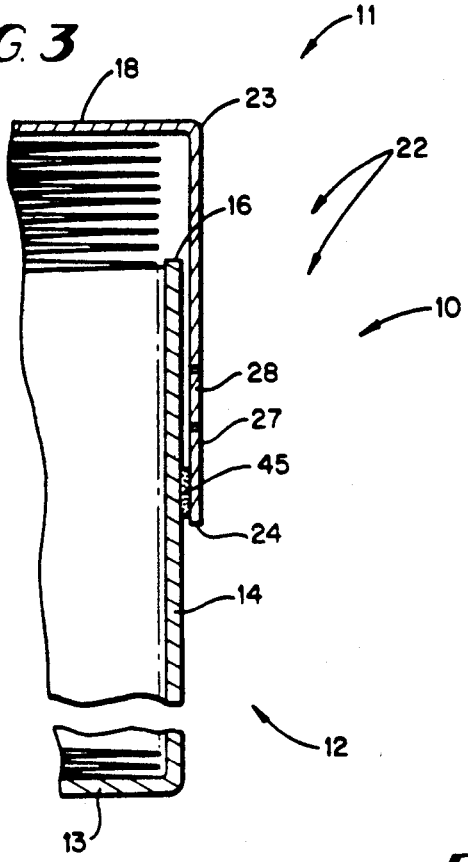
FIG. 3 is a side detail cross-sectional view of the carton of FIG. 1, with the business forms packed thereby shown in elevation.
Figure 4:
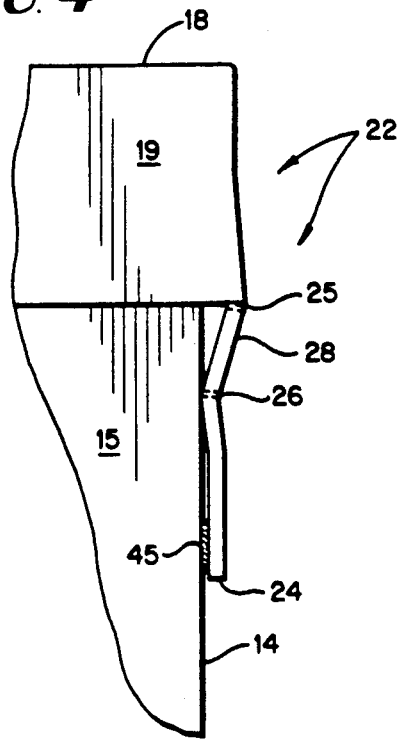
FIG. 4 is a side detail view showing the flexing action of the carton to accommodate varying loads and momentum applied during shipping and handling.

FIGS. 3 and 4 schematically illustrate a particularly desirable feature according to the present invention. As seen in FIG. 3, the carton 10 is filled with substantially nondeformable (that is non-permanently deformable) material, in the particular case illustrated in FIG. 3 a plurality of paper sheets, in the form of continuous business forms, multipart business forms (whether continuous or detached), or like products. The product extends in a stack upwardly from the bottom 13 past the top edge 16 of the carton body 12. The carton is then compressed by pushing down on the lid 11—as will be hereafter described—to reduce the void volume within the stack of business forms or like product, and then adhesive 45—or like fastening means—is utilized to affix the bottom sections 27 of the side panels 22 to the carton body side walls 14.

With the above-identified overpacking of the carton 10, and compressing thereof, the lines of weakness 25, 26 will inherently form flex areas, so that when the carton 10 is subjected to varying loads and momentum during shipping and handling, the carton components can flex (see FIG. 4) rather than having to be rigid enough to withstand such forces without any deformation. This ability to "give" in response to applied forces rather than having to be strong enough to resist such forces allows the carton 10 according to the invention to be constructed of lower weight paperboard, and does not require the use of filler pads. For example, in conventional packaging of business forms, 200 or 275 pound test boxes with or without extra strength 33 pound mediums, and corrugated and Styrofoam ® filler pads, are utilized. According to the invention, however, there is no need for any fillers, and 125 pound, 150 pound or 175 pound test corrugated paperboard may be utilized for both the carton body and the lid. While more paperboard material (square footage) is necessary because of the elongated side panels 22, since the weight is less, the cost of the carton 10 according to the invention will be less than that of a comparable conventional carton having the same protecting qualities.

Figure 8:
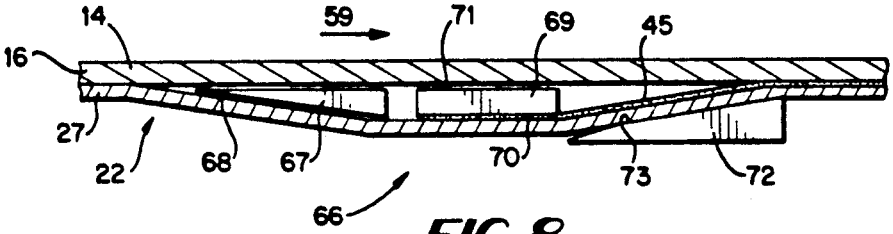
FIG. 8 is a top detail view of the gluing section components of the apparatus of FIGS. 6 and 7, shown in association with a carton side wall and lid side section.
Figure 6:
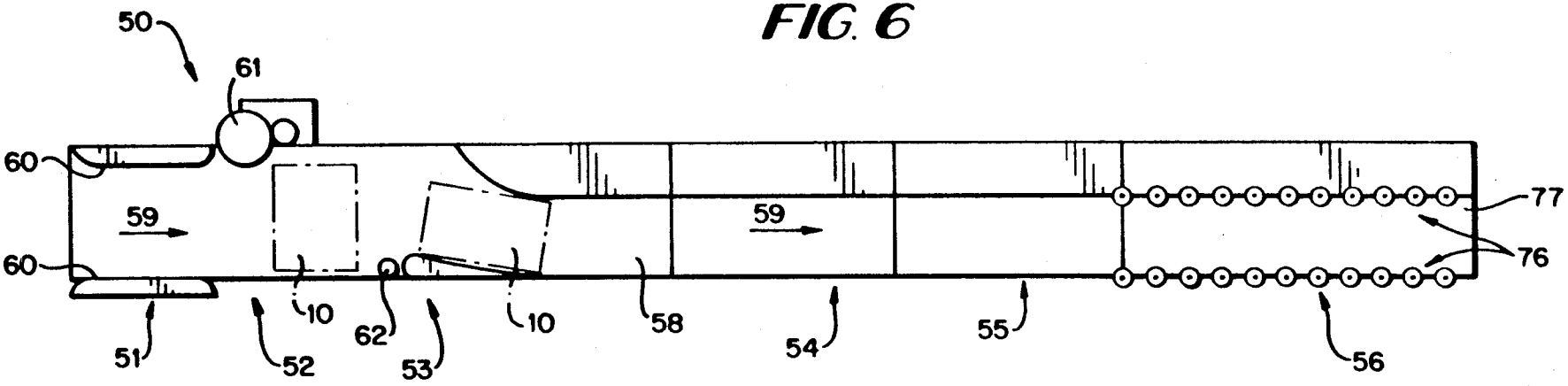
FIG. 6 is a top plan schematic view of exemplary apparatus for packing a carton according to the method of the invention.
Figure 7:
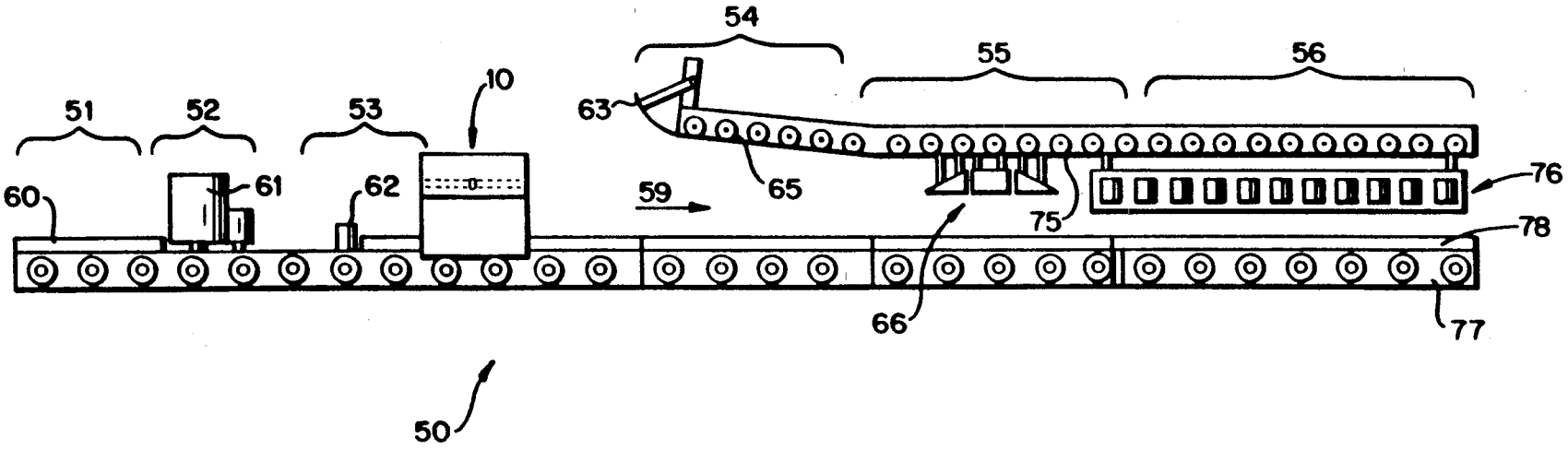
FIG. 7 is a side schematic view of the apparatus of FIG. 6.

FIGS. 6 through 8 schematically illustrate apparatus that is utilized for practicing the method of packing a cardboard carton according to the invention. It is to be understood that the apparatus itself is not part of this invention, but merely shows a good exemplary way of practicing the method according to the invention.

The apparatus is illustrated generally at 50 in FIGS. 6 and 7, and includes an aligning section 51, an encoding section 52, a turning section 53, a compressing section or stage 54, an affixing, bonding, or adhesion stage 55, and a further compression and accumulation stage 56. The apparatus 50 includes a conventional conveyor 58, such as powered horizontal axis rollers, which transport the carton 10 up to the last section 56. The carton 10 is conveyed in the direction of arrow 59 in FIGS. 6–8, the carton 10 first being aligned by the guides 60, and then being encoded by the encoding wheel 61, engaging the turning post 62, and then being turned so that the elongated (side) panels face in the direction of conveyance 59.

When moving in direction 59, the carton 10 (comprising lid 11 and body 12) encounters a guide or cam 63 which engages the lid 11 and gradually moves it into contact with the upper horizontal axis rollers 65, which—as illustrated in FIG. 7—are disposed at an angle with respect to the power rollers 58 so that the distance between the rollers 65 and the rollers 58 is gradually decreased as the carton 10 moves in the direction of conveyance 59. This action compresses the carton 10, removing a significant amount of the void volume within the carton since the product in the carton is above the top edge 16 of the carton body 12 (see FIG. 3). While the carton 10 is held in this compressed condition, it engages the gluing or adhesion apparatus 66.

The gluing or adhesion apparatus 66—as seen most clearly in FIG. 8—preferably comprises a first element 67 having a wedge shape including a cam surface 68 which engages the side panel 22 at the bottom section 27 thereof and cams it outwardly, away from the side wall 14 of the carton bottom 12. The bottom section 27 of the side panel 22 then comes in contact with the glue applicator 69, which has surfaces 70, 71 thereof which respectively engage the inside of the side panel 22, and the exterior of the side wall 14. Glue may be applied by one or both of the surfaces 70, 71 to the cardboard. In FIG. 8 the surface 70 of applicator 69 has applied the glue 45 to the interior surface of the side panel 22 bottom section 27, which is then cammed back into contact with the side panel 14 by the element 72 having a wedge shape, including the linear cam portion 73. During this entire time, the rollers 75—rotatable about a horizontal axis—maintain a compressive force on the lid 11.

After passing through the affixing stage 55, the carton 10 enters the accumulation stage 56 which includes means for maintaining the compressive force on the lid and applying an inward compressive force to the side panels to adhesively bond the side panels to the side walls of the carton. Preferably two rows of vertical axis rollers 76 are provided, with an adjustable spacing therebetween and preferably is spaced in such a way—or biased by springs or the like—so that they apply an inward force to the side panels 22. In the stage 56 the top rollers 75 are continued, and also bottom rollers 77 are provided, the rollers 77—unlike the rollers 58—being nonpowered. In addition to maintaining compression of the lid 11 on the carton body 12, stage 56 also accumulates cartons. Guides 78, like guides 60, also may be provided. Most plants, although utilized differently than as described above, have existing apparatus like that in stage 56.

While particular apparatus has been described above, it is to be understood that the apparatus described is totally exemplary, and that many other inexpensive comparable components can be utilized for performing the same functions. For example, the rollers 65, 75 can be spring biased downwardly, rods or other pressure bearing devices may be utilized instead of the vertical axis rollers 76, etc. Also, while the elements of the gluing section 66 are illustrated as supported from above—with supports exteriorly of the carton sides and extending downwardly to below the elements 67, 69, 72—they can, of course, be supported by legs upstanding from the bottom stationary side edges of the conveyor 58. Further, glue application in section 55 may be by spraying, extruding, or positively flowing onto the cardboard; or replaced by automatic stapling equipment, or automatic taping equipment (e.g. using security thread or security printed pressure sensitive or gummed tape).

It will be seen that the carton 10 produced according to the present invention will securely maintain the contents thereof during shipping and handling without the necessity for any plastic strapping. Also, the lid 11 is reusable. After the strips 28 on both sides of the carton 11 have been removed and the lid 11 detached, the lid can be periodically replaced and removed, just like a conventional cardboard carton lid. If it is necessary to ship the product in the carton 10 again, after the carton is filled the lid may be taped on the sides and/or ends thereof.

It will thus be seen that according to the present invention an advantageous method of packing a cardboard carton, and an improved cardboard carton and lid therefor, have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A distinct cardboard carton lid, completely separate from a carton, and comprising:

a top panel;

first and second end panels each having a top edge and bottom edge, and extending generally perpendicular to said top panel and connected thereto at the top end of each, said bottom edge of each spaced a first distance from said top panel;

two opposite, substantially identical, side panels each having a top edge and bottom edge, and extending generally perpendicular to said top panel and connected to said top panel at the top edge thereof, said bottom edge spaced a second distance from said top panel;

a first line of weakness formed in each of said side panels generally parallel to said top edge and between said top and bottom edges thereof and is spaced said first distance from said top edge of said side panel, and a second line of weakness formed in each of said side panels generally parallel to said first line, and between said bottom edge and said first line; and the spacing between said second line of weakness and said bottom edge of each of said side panels being sufficient to define a bottom, fastening section of sufficient dimension to be securely attachable to a carbon body.

2. A cardboard carton lid as recited in claim 1 wherein said lines of weakness comprise perforations, and a removable strip is provided between said lines of weakness; and further comprising means for facilitating grasping of said removable strip between said lines of weakness to allow tearing of said side panel at said perforations so that said bottom, fastening section of said side panel is detached from the rest of said lid.

3. A cardboard carton lid as recited in claim 2 wherein said means for facilitating grasping of said removable strip comprises a die cut blank formed in said strip.

4. A cardboard carton lid as recited in claim 3 wherein said means for facilitating grasping of said removable strip further comprises die cut lines adjacent said blank and forming a part of said lines of weakness and extending a short distance from said blank.

5. A cardboard carton lid as recited in claim 4 wherein said die cut lines extend at a slight angle with respect to said perforations so as to provide an enlarged grasping portion of said strip therebetween.

6. A cardboard carton lid as recited in claim 5 wherein said blank is provided in a center panel of said strip, and wherein said die cut lines extend from both sides of said blank, and a pair of enlarged grasping portions are provided.

7. A cardboard carton lid as recited in claim 3 wherein said blank is provided in a center section of said strip.

8. A cardboard carton lid as recited in claim 1 formed of 175 pound test, or less, corrugated paperboard.

9. A cardboard carton lid as recited in claim 1 wherein the spacing between said side panel bottom edge and said second line of weakness is about $\frac{3}{4}$-$1\frac{1}{2}$ inches, and wherein the spacing between said lines of weakness is about $\frac{1}{2}$-1 inch.

10. A cardboard carton lid as recited in claim 1 wherein each of said side panels has a side edge which is attached to said top panel along the entire length thereof.

11. A cardboard carton comprising:

a body having opposite side and end walls, a closed bottom, and an open top defined by a top edge;

a lid for closing said top, said lid comprising: a top panel; first and second end panels each having a top edge and bottom edge, and extending generally perpendicular to said top panel and connected thereto at the top end of each, said bottom edge of each spaced a first distance from said top panel; at least one side panel having a top edge and bottom edge, and extending generally perpendicular to said top panel and connected to said top panel at the top edge thereof, said bottom edge spaced a second distance—greater than said first distance—from said top panel; a first line of weakness formed in said side panel generally parallel to said top edge and between said top and bottom edges thereof, and a second line of weakness formed in said side panel generally parallel to said first line, and between said bottom edge and said first line, said first and second lines of weakness defining a flex area so that a packed carton can flex when subjected to varying loads, and the spacing between said second line of weakness and said bottom edge of said side panel being sufficient to define a bottom fastening panel of sufficient dimension to be securely attachable to said carton body;

fastening means for fastening said bottom, fastening panel to a said carton body side wall; and said carton filled with sheets of paper, the sheets of paper extending from the carton body bottom in a stack up past the top edge of the carton body.

12. A cardboard carton as recited in claim 11 wherein said at least one side panel comprises two, opposite, substantially identical side panels, fastened to said carton body sidewalls at the bottom, fastening sections thereof.

13. A cardboard carton as recited in claim 11 wherein the sheets of paper are continuous business forms.

14. A cardboard carton as recited in claim 12 wherein the cardboard of which the carton body and lid are made is 175 pound test, or less, corrugated paperboard, and wherein the carton consists of said body, lid, and paper, being devoid of packing fillers.

15. A cardboard container as recited in claim 12 wherein said fastening means comprises adhesive between said bottom, fastening sections of said lid and said side walls of said carton body.

16. A cardboard carton as recited in claim 15 wherein said lid lines of weakness comprise perforations, and a removable strip is provided between said lines of weakness, and further comprising means for facilitating grasping of said removable strip between said lines of weakness to allow tearing of said side panel at said perforations so that said bottom, fastening section of said side panel is detached from the rest of said lid.

17. A cardboard carton as recited in claim 16 wherein said means for facilitating grasping of said removable strip comprises a die cut blank formed in said strip.

18. A cardboard carton as recited in claim 17 wherein said means for facilitating grasping of said removable strip further comprises die cut lines adjacent said blank and forming a part of said lines of weakness and extending a short distance from said blank.

19. A cardboard carton as recited in claim 12 wherein each of said side panels has a side edge which is attached to said top panel along the entire length thereof.

20. A cardboard carton comprising:

a body having opposite side and end walls, a closed bottom, and an open top defined by a top edge;

a lid for closing said top, said lid comprising: a top panel; first and second end panels each having a top edge and bottom edge, and extending generally perpendicular to said top panel and connected thereto at the top end of each, said bottom edge of each spaced a first distance from said top panel; two opposite, substantially identical side panels each having a top edge and bottom edge, and extending generally perpendicular to said top panel and connected to said top panel at the top edge thereof, said bottom edge spaced a second distance—greater than said first distance—from said top panel; a first line of weakness formed in said side panel generally parallel to said top edge and between said top and bottom edges thereof and is spaced said first distance from said top edge of said side panels, and a second line of weakness formed in each of said side panels generally parallel to said first line, and between said bottom edge and said first line; and the spacing between said second line of weakness and said bottom edge of each of said side panels being sufficient to define a bottom, fastening panel of sufficient dimension to be securely attachable to said carton body; and fastening means for fastening said bottom, fastening panel to a said carton body side wall.

21. A cardboard carton as recited in claim 20 wherein each of said side panels has a side edge which is attached to said top panel along the entire length thereof.

* * * * *

UNITED STATES PATENT AND TRADEMARK OFFICE

CERTIFICATE OF CORRECTION

PATENT NO. : 5,105,950

DATED : April 21, 1992

INVENTOR(S) : Gottfreid et al

It is certified that error appears in the above-identified patent and that said Letters Patent is hereby corrected as shown below:

On the title page, should read:

[73] Assignee: Moore Business Forms, Inc., Grand Island, N.Y.; Inland Container Corp., Indianapolis, Indiana Signed and Sealed this Twenty-ninth Day of March, 1994

*Attest:*

Bruce Lehman

BRUCE LEHMAN

*Attesting Officer*

*Commissioner of Patents and Trademarks*